US010806315B2

(12) United States Patent
Geyer

(10) Patent No.: US 10,806,315 B2
(45) Date of Patent: Oct. 20, 2020

(54) VACUUM CLEANER ATTACHMENT DEVICE AND SYSTEM

(71) Applicant: Jay D. Geyer, Williston, ND (US)

(72) Inventor: Jay D. Geyer, Williston, ND (US)

( * ) Notice: Subject to any disclaimer, the term of this patent is extended or adjusted under 35 U.S.C. 154(b) by 311 days.

(21) Appl. No.: 15/935,749

(22) Filed: Mar. 26, 2018

(65) Prior Publication Data

US 2018/0213988 A1 Aug. 2, 2018

Related U.S. Application Data

(63) Continuation-in-part of application No. 15/078,877, filed on Mar. 23, 2016, now abandoned.

(60) Provisional application No. 62/141,929, filed on Apr. 2, 2015.

(51) Int. Cl.

| | |
|---|---|
| ***A47L 9/10*** | (2006.01) |
| ***A47L 5/36*** | (2006.01) |
| ***A47L 9/12*** | (2006.01) |

(52) U.S. Cl.

CPC ..... *A47L 9/102* (2013.01); *A47L 5/36* (2013.01); *A47L 9/127* (2013.01)

(58) Field of Classification Search

None

See application file for complete search history.

(56) References Cited

U.S. PATENT DOCUMENTS 2,219,567 A * 10/1940 Spielman ..... A47L 5/365 55/372

2011/0283475 A1* 11/2011 Cappuccio ..... A47L 7/0014 15/327.1

* cited by examiner

*Primary Examiner* — David Redding

(74) *Attorney, Agent, or Firm* — Olav M. Underdal; IDP Patent Services

(57) ABSTRACT

A filtered vacuum cleaner system includes a vacuum cleaner, a vacuum filter device, including a collection box with a collection cavity, a lid, a filter air intake, a filter air exhaust, inlet and outlet pipes, a handle, and a filter unit; a vacuum connection hose, and a filter hose, and optionally a vacuum handle unit, such that the vacuum filter device attaches to an air intake of the vacuum cleaner, such that the vacuum filter device filters debris from air prior to the air entering the vacuum cleaner.

23 Claims, 8 Drawing Sheets

Filtered Vacuum Cleaner System

Vacuum Filter Device

VACUUM CLEANER ATTACHMENT DEVICE AND SYSTEM

CROSS-REFERENCE TO RELATED APPLICATIONS

This application is a continuation-in-part of U.S. Non-Provisional application Ser. No. 15/078,877, filed Mar. 23, 2016, which claims the benefit of U.S. Provisional Application No. 62/141,929, filed Apr. 2, 2015; all of which are hereby included herein by reference in their entirety.

International Application No. PCT/US2016/25376, filed Mar. 31, 2016, is hereby included herein by reference in its entirety.

FIELD OF THE INVENTION

The present invention relates generally to the field of vacuum cleaners, and more particularly to methods and systems for vacuum cleaner attachment devices and systems.

BACKGROUND OF THE INVENTION

Vacuum cleaners are used as an everyday household appliance to collect dust and other small debris. Most vacuum cleaners have an internal filter to remove the dust and debris before it enters the motor and fan components. However, these filters can easily become clogged by dirt, dust, and other types of debris.

If a vacuum cleaner becomes clogged, it can be extremely difficult to clear the clog and clean the filter. The suction of the vacuum is also significantly reduced. If a person tries to use a clogged vacuum, the internal component can be damaged. Related vacuum cleaner repairs and replacement parts can be expensive.

As such, considering the foregoing, it may be appreciated that there continues to be a need for novel and improved devices and methods for improving the suction and reducing clogging of vacuum cleaners.

SUMMARY OF THE INVENTION

The foregoing needs are met, to a great extent, by the present invention, wherein in aspects of this invention, enhancements are provided to the existing model of vacuum cleaners by proving an attachment device and system, which can filter the suctioned particles in an attachment receptacle prior to entering a vacuum.

In an aspect, a filtered vacuum cleaner system can include:

a) a vacuum cleaner, with an air pump to suck up and collect dust and dirt through a vacuum air intake;

b) a vacuum filter device, including:

- a collection box, including a collection cavity;
- a lid, which attaches to an upper end of the collection box, such that the lid is removable and airtight when attached to the upper end;
- a filter air intake, which forms an opening into the collection cavity;
- a filter air exhaust, which forms an opening into the collection cavity; and
- a filter unit; and c) a vacuum connection hose;

d) a filter connection hose;

such that the filter air exhaust is connected to the vacuum air intake via the vacuum connection hose;

such that air is sucked into the collection cavity through the filter air intake, such that the air passes through the collection cavity, whereby debris collects in a bottom of the collection cavity;

such that the air passes through the filter unit, which collects remaining debris from the air;

such that the air passes through to the vacuum cleaner, via the vacuum connection hose.

In a related aspect, the filtered vacuum cleaner system can further include:

a filter connection hose;

such that a first end of the filter connection hose is connected to the filter air intake, such that air is sucked in through the vacuum connection hose.

In related aspects, the filtered vacuum cleaner system can further include:

a vacuum handle unit; including:

- a vacuum handle unit air intake; and
- a vacuum handle unit air exhaust;

wherein the vacuum handle unit air intake and the vacuum handle unit air exhaust are configured to be in fluid connection; and wherein a second end of the filter connection hose is connected to the vacuum handle unit air exhaust.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
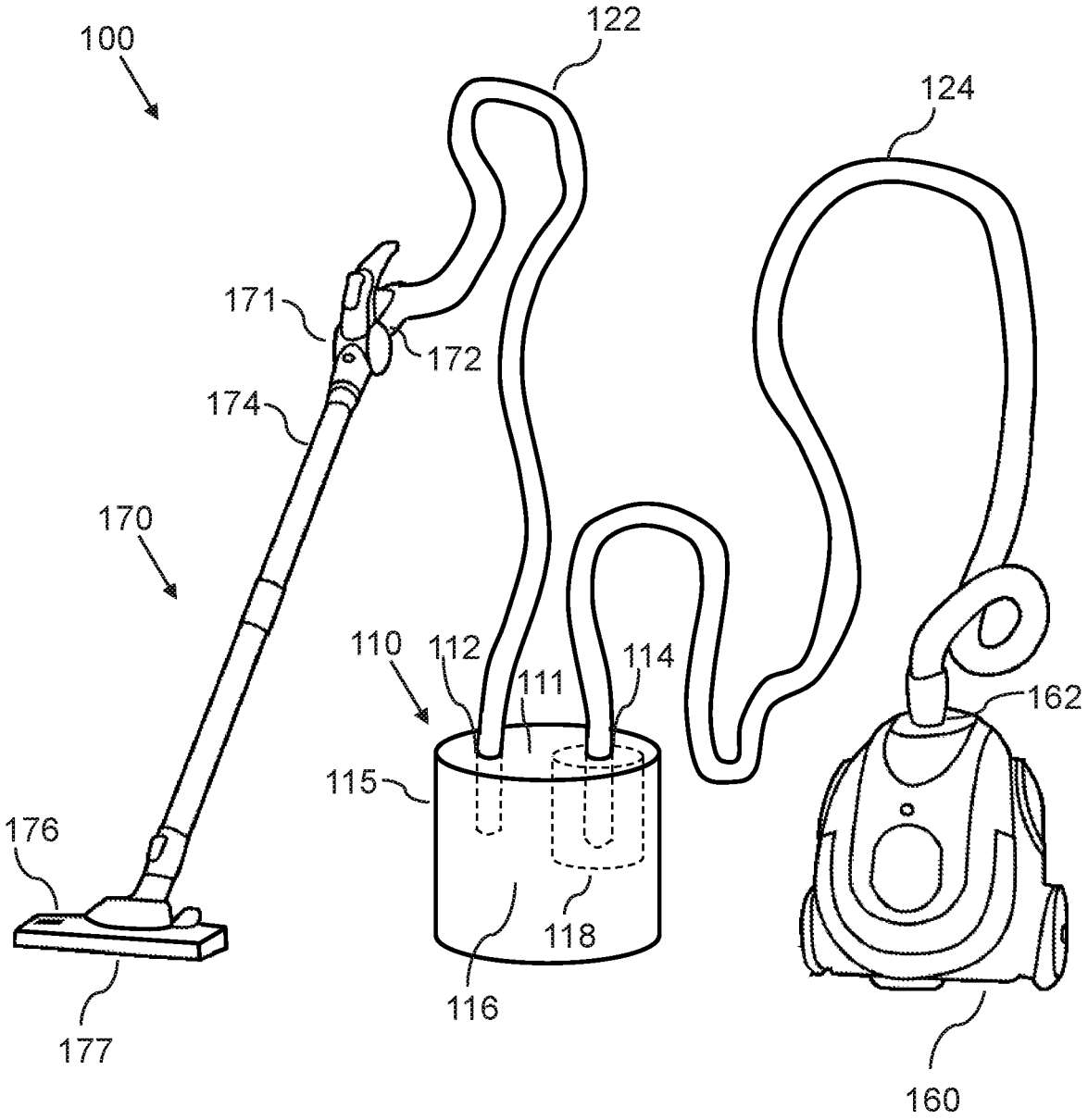
FIG. 1 is a perspective of a filtered vacuum cleaner system, according to an embodiment of the invention.

In the following, we describe the structure of an embodiment of a filtered vacuum cleaner system 100 with reference to FIG. 1, in such manner that like reference numerals refer to like components throughout; a convention that we shall employ for the remainder of this specification.

In an embodiment a filtered vacuum cleaner system 100 can include:

a) a vacuum cleaner 160, which is configured with an air pump to suck up and collect dust and dirt through a vacuum air intake 162;

b) a vacuum filter device 110, which is a closed unit, which can include:

i. a collection box 115 comprising a collection cavity 116; and ii. a lid 111, which is configured to attach to an upper end of the collection box 115 515, such that the lid 111 can be removable, to enable easy cleaning of the vacuum attachment, and airtight when attached to the upper end;

iii. a filter air intake 112, which is configured as an opening into the collection cavity 116;

iv. a filter air exhaust 114, which is configured as an opening into the collection cavity 116;

v. a filter unit 118;

b) a vacuum connection hose 124;

c) a filter connection hose 122; and optionally d) a vacuum handle unit 170; which can include i. a vacuum head 176, further comprising a vacuum handle unit air intake 177;

ii. a hollow shaft 174; and iii. a handle grip 171;

iv. a vacuum handle unit air intake 177;

wherein the vacuum air intake 162 is connected to the filter air exhaust 114 via the vacuum connection hose 124;

wherein a first end of the filter connection hose 122 is connected to the filter air intake 112;

such that air is sucked into the collection cavity 116 through the filter connection hose 122, such that the air passes through the collection cavity 116, wherein the air contains debris, including dust and dirt, whereby some of the debris collects in a bottom of the collection cavity 116;

such that the air passes through the filter unit 118, which is configured to collect debris from the air;

such that the air passes through to the vacuum cleaner 160, via the vacuum connection hose 124;

wherein, optionally, a second end of the filter connection hose 122 is connected to the vacuum handle unit air exhaust 172 of the vacuum handle unit 170.

In a related embodiment, the filter unit 118 is configured to prevent a substantial amount of dust or any other clogging items to be suctioned into the dust container within the vacuum cleaner 160.

In another related embodiment, the filter unit 118 can be a large pool filter.

In yet a related embodiment, the filter unit 118 can be composed of nylon mesh.

In yet a related embodiment, collection cavity 116 can be large enough to store large quantities of dirt, dust, and debris.

In yet another related embodiment, the vacuum filter device 110 can extend the life of a vacuum cleaner 160, by significantly reducing the amount of debris that enters the vacuum cleaner 160, and can offer ease and convenience when cleaning a home, automobile, and more.

Figure 2:
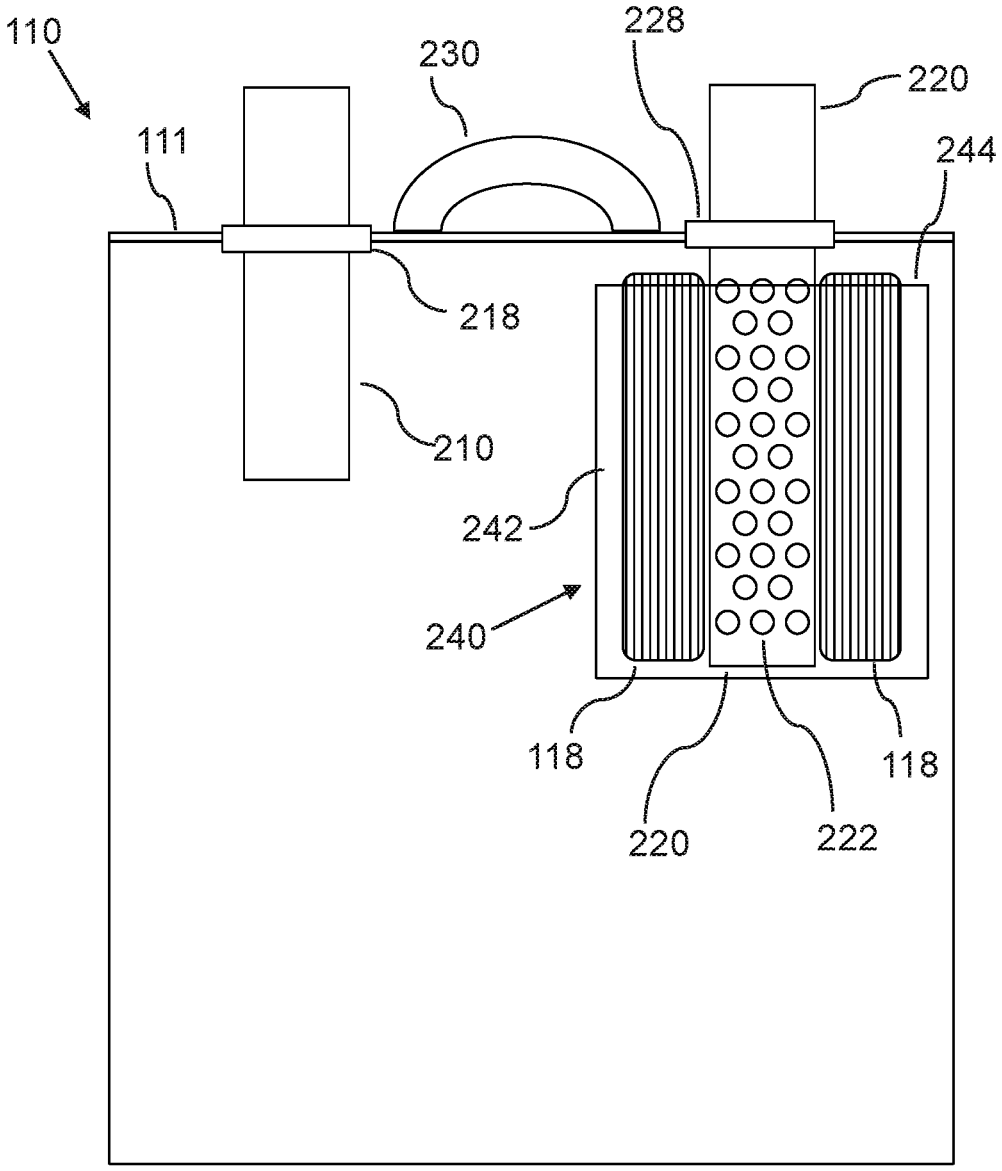
FIG. 2 is a schematic diagram illustrating a cross-sectional view of a vacuum filter device, according to an embodiment of the invention.

In a related embodiment, FIG. 2 shows a side cross sectional view of a vacuum filter device 110, illustrating that, in some embodiments:

a) the filter connection hose 122 and the vacuum connection hose 124 can attach to a top part of the vacuum filter device 110;

b) the vacuum filter device 110 can further include:

i. an inlet pipe 210, which is a hollow pipe, which is in fluid connection with the collection cavity 116 via the filter air intake 112, for example such that the inlet pipe 210 protrudes through the filter air intake 112, such that the inlet pipe 210 extends into the collection cavity 116, and can be mounted through a slip fit sealing gasket 218, such that an inner end of the filter connection hose 122 can be attached to an outer end of the inlet pipe 210;

a) a top end of the outlet pipe 220 can be slightly tapered to facilitate easy slide-on connect of the vacuum connection hose 124;

b) the filter unit 118 can be located within the vacuum filter device 110, beneath the vacuum connection hose 124, inside the collection cavity 116;

c) the vacuum filter device 110 can further include a handle 230, for example mounted between the two air hoses 122 124, such that a user can grab the handle to carry the vacuum filter device 110;

d) the vacuum filter device 110 can further include:

ii. an outlet pipe 220, which is a hollow pipe, which is in fluid connection with the collection cavity 116 via the filter air exhaust 114, for example such that the outlet pipe 220 extends into the collection cavity 116 via the filter air exhaust 114, and can be mounted through a slip fit sealing gasket 228, such that an inner end of the vacuum connection hose 124 can be attached to an outer end of the outlet pipe 220;

such that the filter unit 118 is mounted on an inner end of the outlet pipe 220, wherein the inner end comprises:

1. a plurality of pipe apertures 222, which are configured to allow air to flow into the outlet pipe 220;

e) a top end of the outlet pipe 220 can be slightly tapered to facilitate easy slide-on connect of the vacuum connection hose 124;

In a related embodiment, the filter unit 118 can for example be configured as an elongated tube with a central elongated cavity, such that the filter unit 118 slides on to the inner end of the outlet pipe 220, such that the inner end of the outlet pipe 220, is inside the central elongated cavity.

In a related example embodiment, the filter unit 118 can be configured with an outer diameter of 5 inches and a length of 8 inches.

In a related example embodiment, the filter unit 118 can be configured with a 1.5 inch internal connection diameter, such that the filter unit 119 is configured to slide onto an outlet pipe 220 with a 1.5 inch outer diameter.

In various related embodiments, outlet pipe 220 can be configured to receive any type, make, and model of vacuum connection hose 124.

In a related example embodiment, the outlet pipe 220 can have a diameter of 1.5 inches, and the pipe apertures 222 can have a diameter of 0.5 inches.

Figure 3:
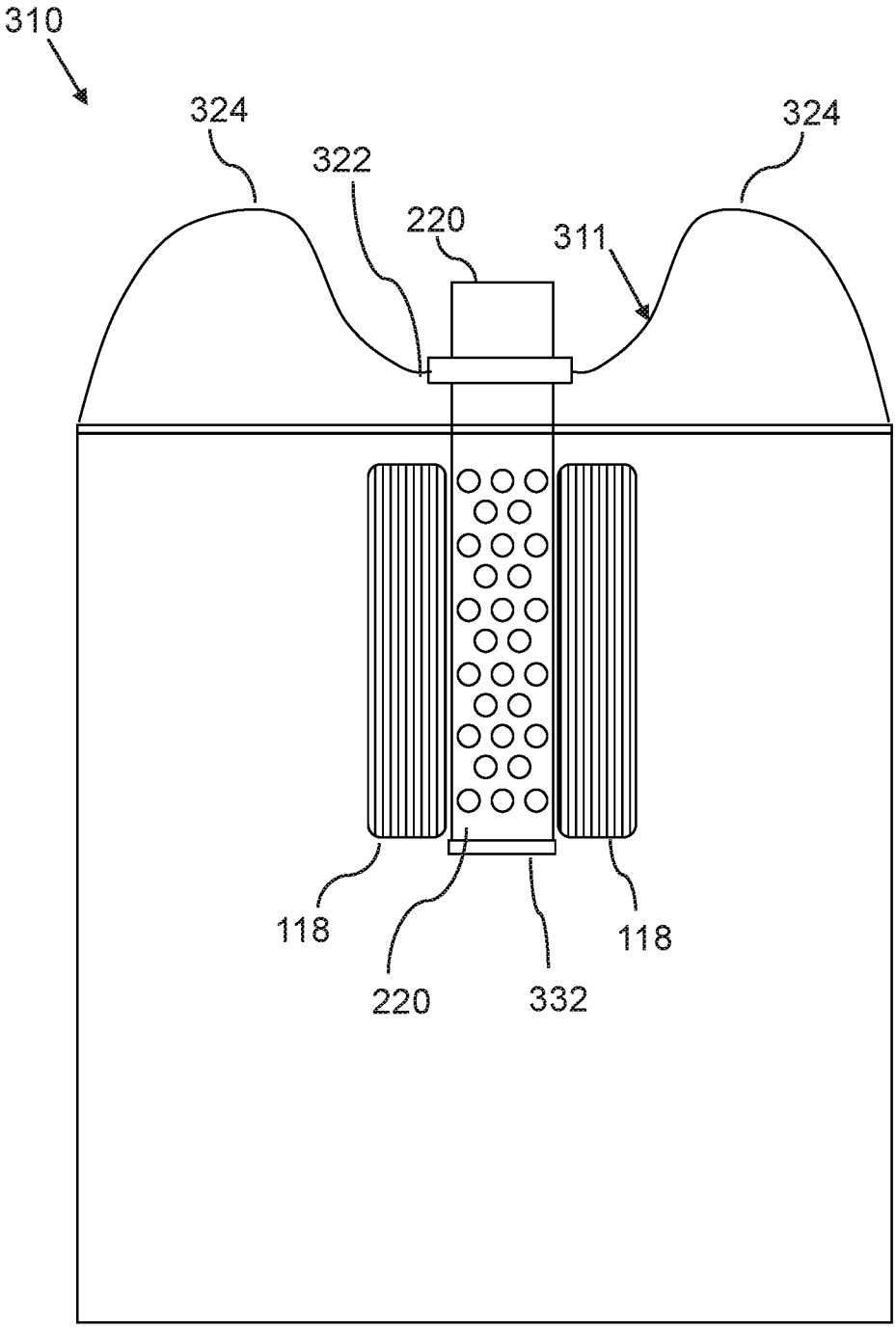
FIG. 3 is a schematic diagram illustrating a cross-sectional view of a vacuum filter device, according to an embodiment of the invention.

In another related example embodiment, the vacuum connection hose 124 can have a diameter of 1.25-1.5 inches In a related embodiment, as shown in FIG. 3, which shows a side view, along a side that is perpendicular to the section view of FIG. 2, a vacuum filter device 310 can be configured with a lid or top part 311, which can be m-shaped. The air hoses 122 124 can be mounted in a valley 322 between two peaks 324, which form the m-shape.

In a related embodiment, the top 311 and the collection box 115 can be sealed with a rubber seal, which forms an airtight seal when the top 311 is mounted in place on the collection box 115.

In various related embodiments, the vacuum filter device 110 can be configured in various sizes, including as five, seven, and ten gallon containers.

In various related embodiments, the vacuum filter device 110 can be configured in various sizes, including as shown with a bucket-like circular shape, rectangular, or shaped as a carry bag, such as a duffel bag.

In various related embodiment, the vacuum filter device 110 can be made from plastic or other suitable materials.

In a related embodiment, as shown in FIG. 3, the outlet pipe 220 may have a cap 332 mounted on an inner end, to prevent dirt and debris from circumventing the filter material. Alternatively, a cap may be disposed on an entrance or outer end of the filter unit 118.

Figure 4:
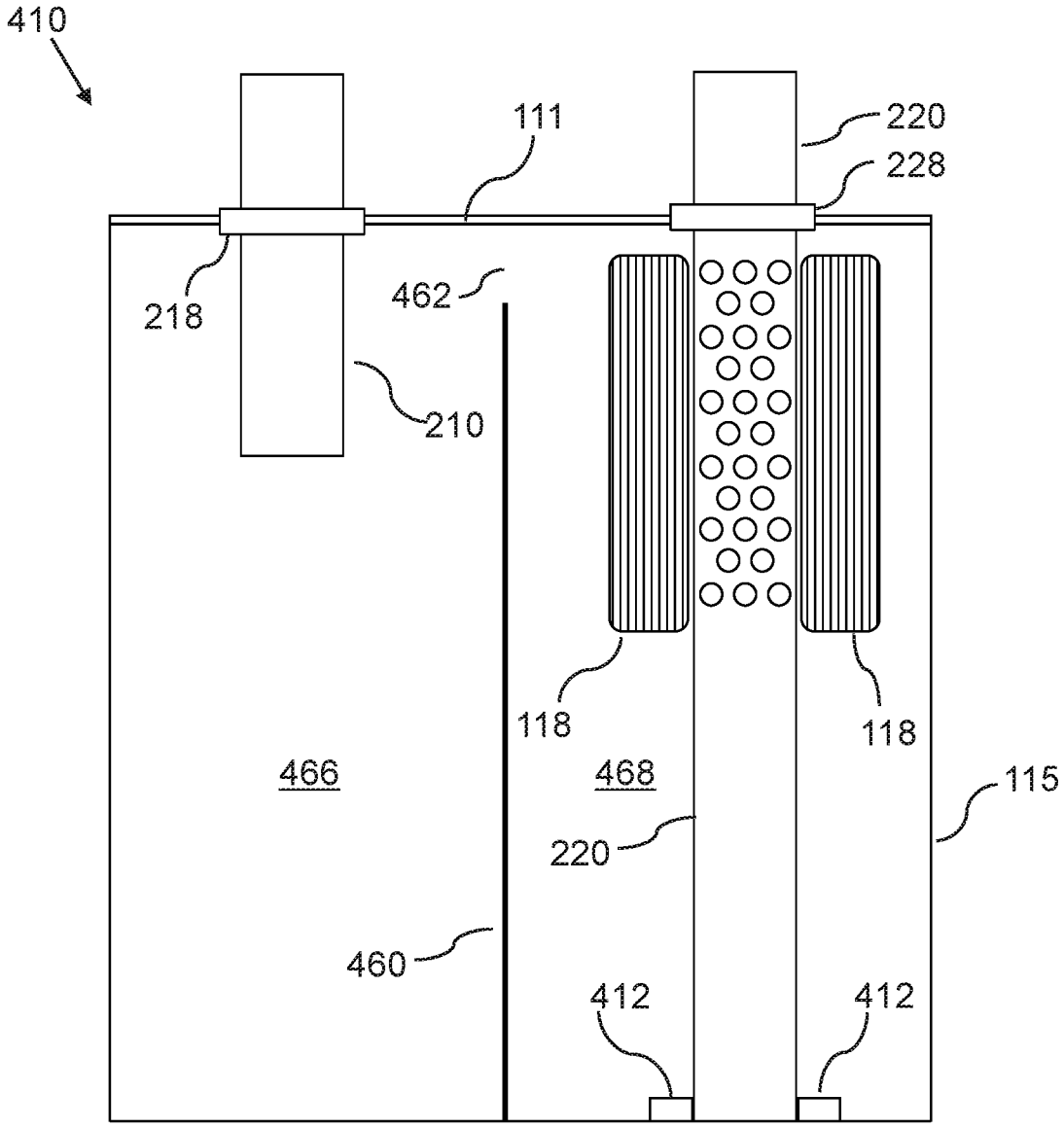
FIG. 4 is a schematic diagram illustrating a cross-sectional view of a vacuum filter device, according to an embodiment of the invention.

In a related embodiment, as shown in FIG. 4, a vacuum filter device 410 can be configured with an outlet pipe 220 that is configured with a predetermined length to extend to the bottom of the collection cavity 116, where it can be secured in a pipe holder 412, which can be a circular bracket, or of some other shape configured to hold and secure the outlet pipe 220.

In a related embodiment, the vacuum filter device 410 can further include a separation plate 460, which can be vertically mounted, to create a separation between a container portion 466 and a filter portion 468 of an interior of the collection box 115, such that the filter unit 118 is mounted in the filter portion 468, such that air flows from the container portion to the filter portion via an aperture 462 above the separation plate, or alternatively via apertures in an upper portion of the separation plate 460, whereby the separation plate 460 serves to contain dust and other particles in container portion 466.

Figure 5:
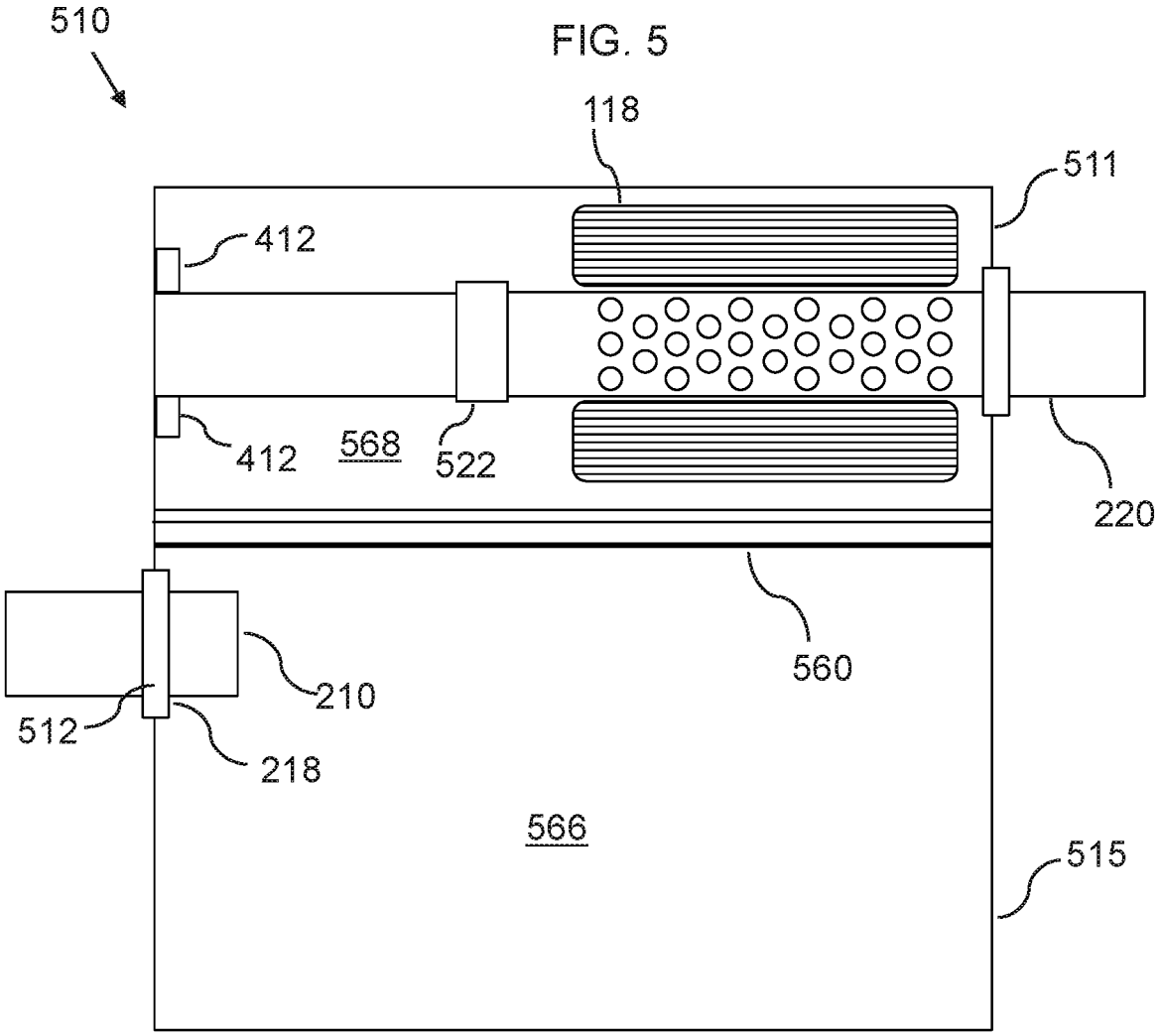
FIG. 5 is a schematic diagram illustrating a cross-sectional view of a vacuum filter device, according to an embodiment of the invention.

In a related embodiment, as shown in FIG. 5, a vacuum filter device 510 can be configured such that the filter unit 118 is mounted horizontally in a lid 511, such that the outlet pipe 220 extends horizontally into the lid 511, through a side of the lid 511. Similarly, the inlet pipe 210 can extend horizontally into the collection cavity 116, through a side of the collection cavity 116.

Figure 6A:
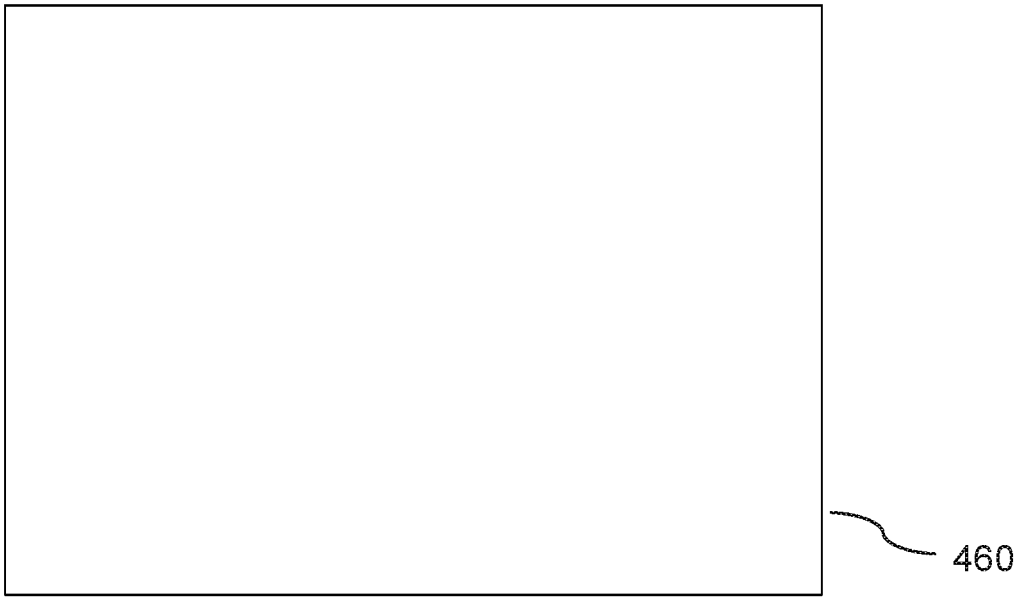
FIG. 6A is a side view of a separation plate of a vacuum filter device, according to an embodiment of the invention.
Figure 6B:
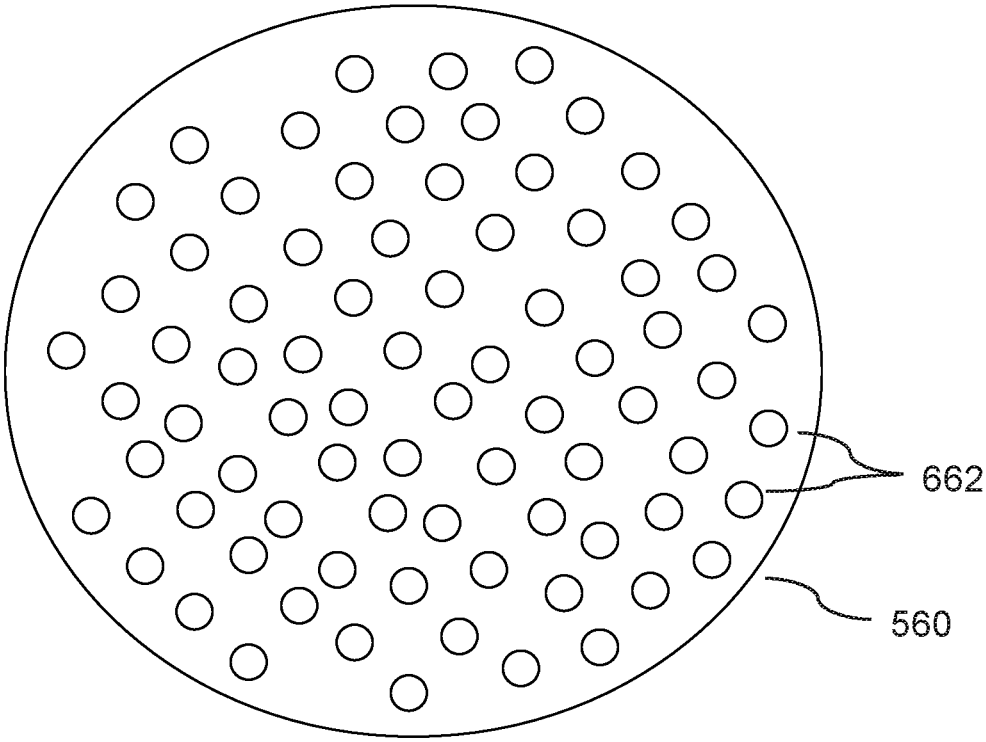
FIG. 6B is a top view of a separation plate of a vacuum filter device, according to an embodiment of the invention.

In a related embodiment, the vacuum filter device 510 can further include a separation plate 560, which can be horizontally mounted inside an interior of the vacuum filter device 510, to create a separation between a container portion 566 and a filter portion 568 of the interior of the collection box 515, such that the filter unit 118 is mounted in the filter portion 568, such that air flows from the container portion to the filter portion via apertures 662 in the separation plate 560, as shown in FIG. 6B, whereby the separation plate 560 serves to contain debris, including dust and other particles, in the container portion 566.

Figure 7:
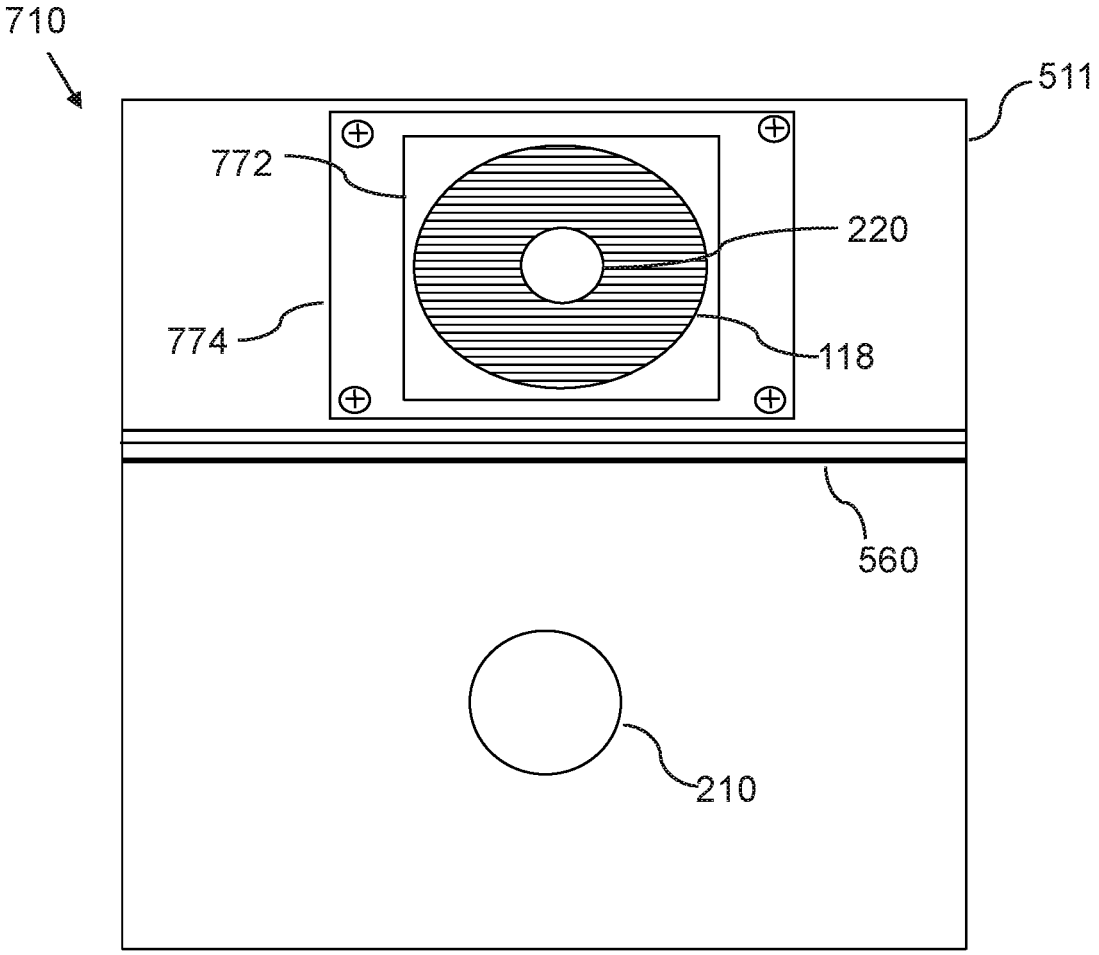
FIG. 7 is a side view of a vacuum filter device, according to an embodiment of the invention.

In another related embodiment, as shown in FIG. 7, the vacuum filter device 710 can further include a filter access aperture 772 and a filter access cover plate 774, both for example positioned in a side of the vacuum filter device 710, such that the filter access aperture 772 is configured to provide access for insertion and removal of the filter unit 118, and such that the filter access cover plate 774 is configured to be removably positioned to close the filter access aperture 772.

In further related embodiment, the outlet pipe 220 can be extended with a coupler 522, as shown in FIG. 5. The coupler 522 can function to:

a) keep the filter unit 118 in place;

b) seal the end of the filter unit 118;

c) aid in assembly and/or disassembly of the vacuum filter device 510; and/or d) allow for different lengths of the outlet pipe 220.

In yet further related embodiments, a coupler 522 can be used with other configurations of the vacuum filter device 110 410 510, such as for example with the vacuum filter device 410, as shown in FIG. 4, such that the outlet pipe 220 further includes a coupler 522.

In a related embodiment, such as shown in FIG. 2, the vacuum filter device 110 can be configured such that the filter unit 118 is mounted vertically in the lid 511, the vacuum filter device 110 can further include a filter holder 240, which can also be referred to as a filter cup 240, such that the filter holder is cup-shaped, such that the filter holder 240 is configured to receive the filter unit 118 in an interior 242 of the filter holder, such that air flows into the filter unit 118 via a holder aperture 244 in an upper portion of the filter holder 242, whereby the filter holder 240 serves to contain debris, including dust and other particles, in a lower part of the collection cavity 116.

Figure 8:
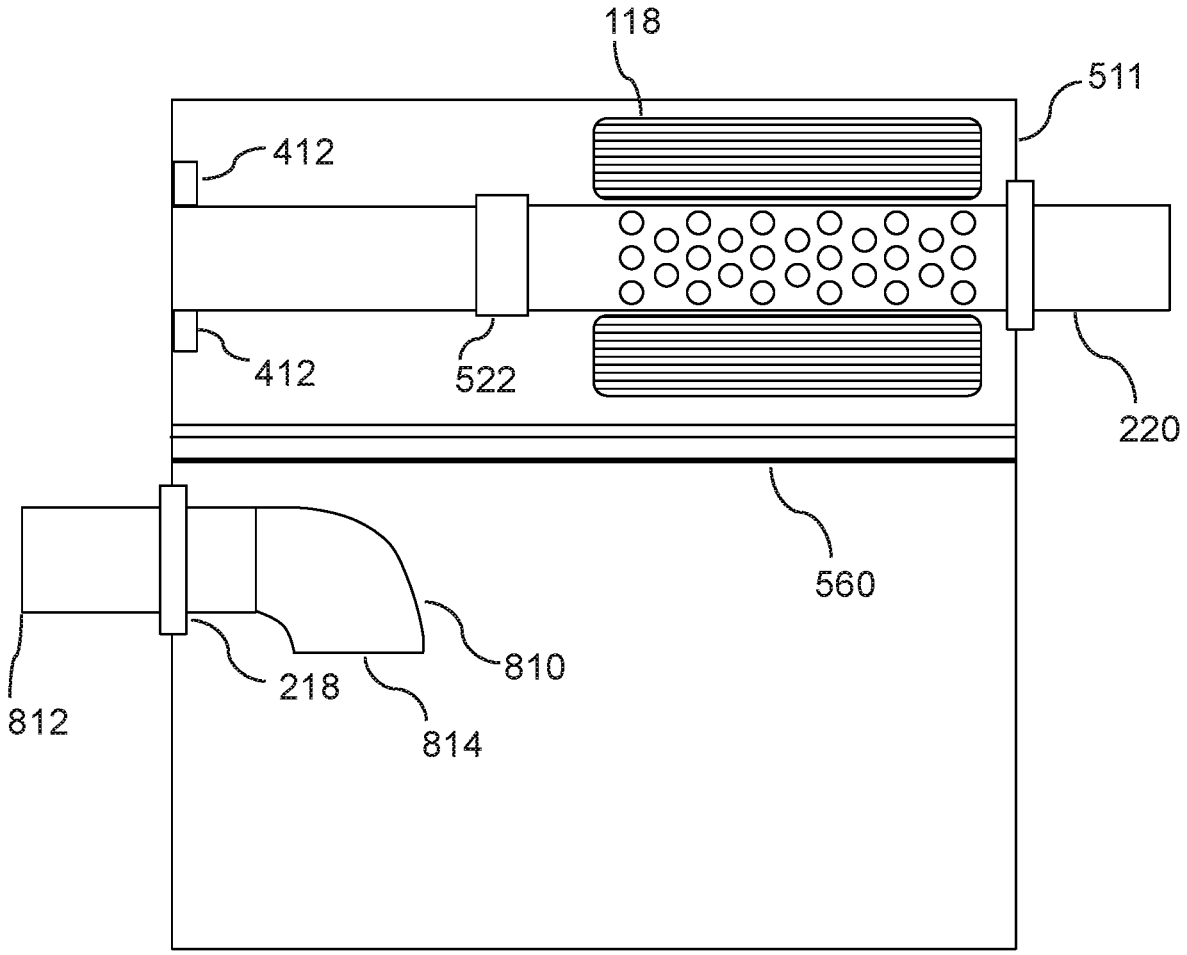
FIG. 8 is a schematic diagram illustrating a cross-sectional view of a vacuum filter device, according to an embodiment of the invention.

In another related embodiment, as shown in FIG. 8, the inlet pipe 810 can be configured with a downward curve, such that an inner end/aperture 814 of the inlet pipe 810 can be directed downward, whereby the downward curve serves to contain dust and other particles in a lower part of the collection box. As shown, an outer end 812 of the inlet pipe can be horizontal, and an inner end 812 can be vertical.

Here has thus been described a multitude of embodiments of the filtered vacuum cleaner system 100, the vacuum filter device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

For example, alternative embodiments can be configured for use with the many different types of vacuum cleaners 160, including canister, upright, and shop vacuums.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A filtered vacuum cleaner system, comprising:

a) a vacuum cleaner, which is configured with an air pump to suck up and collect dust and dirt through a vacuum air intake;

b) a vacuum filter device, comprising:

a collection box, comprising a collection cavity;

a lid, which is configured to attach to an upper end of the collection box, such that the lid is configured to be removable and airtight when attached to the upper end;

a filter air intake, which is configured as a first opening into the collection cavity;

a filter air exhaust, which is configured as a second opening into the collection cavity;

a filter unit; and an outlet pipe, which is in fluid connection with the collection cavity via the filter air exhaust; and c) a vacuum connection hose;

wherein the filter air exhaust is connected to the vacuum air intake via the vacuum connection hose;

such that air is sucked into the collection cavity through the filter air intake, such that the air passes through the collection cavity, wherein the air contains debris, including the dust and dirt, whereby some of the debris collects in a bottom of the collection cavity;

such that the filter unit is configured to pass the air through the filter unit, which is configured to collect some of remaining debris from the air;

such that an inner end of the vacuum connection hose is attached to an outer end of the outlet pipe;

wherein the vacuum filter device is configured such that the filter unit is mounted horizontally in the lid, such that the outlet pipe extends horizontally into the lid, through a side of the lid;

wherein the filter air intake is mounted below the filter air exhaust;

such that the air passes through to the vacuum cleaner, via the vacuum connection hose.

2. The filtered vacuum cleaner system of claim 1, wherein the filter air intake is mounted in a side of the collection box and the filter air exhaust is mounted in a side of the lid.

3. The filtered vacuum cleaner system of claim 1, wherein the vacuum filter device further comprises:

a separation plate, which comprises a plurality of apertures;

wherein the separation plate is horizontally mounted in an interior of the vacuum filter device, to create a separation between a container portion and a filter portion of the interior of the collection box, such that the filter unit is mounted in the filter portion, such that the air flows from the container portion to the filter portion via the plurality of apertures in the separation plate, whereby the separation plate serves to contain the debris in the container portion.

4. The filtered vacuum cleaner system of claim 1, further comprising:

a filter connection hose;

wherein a first end of the filter connection hose is connected to the filter air intake, such that air is sucked in through the filter connection hose.

5. The filtered vacuum cleaner system of claim 1, wherein the vacuum filter device further comprises:

an inlet pipe, which is in fluid connection with the collection cavity via the filter air intake;

such that an inner end of the filter connection hose is attached to an outer end of the inlet pipe.

6. The filtered vacuum cleaner system of claim 1, wherein the inlet pipe is configured with a downward curve, such that an inner end of the inlet pipe is directed downward, whereby the downward curve serves to contain the debris in a lower part of the collection box.

7. The filtered vacuum cleaner system of claim 1, wherein the outlet pipe extends vertically below the lid, into the collection cavity.

8. The filtered vacuum cleaner system of claim 1, wherein the filter unit is configured as an elongated tube with a central elongated cavity, such that the filter unit slides on to an inner end of the outlet pipe, such that the inner end of the outlet pipe, is inside the central elongated cavity.

9. A vacuum filter device for use with a vacuum cleaner, comprising:

a collection box, comprising a collection cavity;

a lid, which is configured to attach to an upper end of the collection box, such that the lid is configured to be removable and airtight when attached to the upper end;

a filter air intake, which is configured as a first opening into the collection cavity;

a filter air exhaust, which is configured as a second opening into the collection cavity;

a filter connection hose; and an outlet pipe, which is in fluid connection with the collection cavity via the filter air exhaust, such that an outer end of the outlet pipe is configured to attach to an inner end of a vacuum connection hose;

wherein the filter air intake is mounted below the filter air exhaust;

wherein a first end of the filter connection hose is connected to the filter air intake, such that air is sucked in through the filter connection hose;

wherein the vacuum filter device is configured to receive a filter unit, such that the filter unit is connectable to the filter air exhaust;

wherein the filter air exhaust is configured to connect to a vacuum air intake of the vacuum cleaner, via the vacuum connection hose;

such that air is sucked into the collection cavity through the filter air intake, such that the air passes through the collection cavity, wherein the air contains debris, including dust and dirt, whereby some of the debris collects in a bottom of the collection cavity;

such that the vacuum filter device is configured to pass the air from the collection cavity through the filter unit, when the filter unit is connected to the filter air exhaust;

such that the vacuum filter device is configured to pass the air through to the vacuum cleaner, via the vacuum connection hose.

10. The vacuum filter device of claim 9, further comprising:

the filter unit;

wherein the filter unit is connected to the filter air exhaust, such that the filter unit is configured to collect some of remaining debris from the air.

11. The vacuum filter device of claim 10 wherein the filter unit is mounted horizontally in the lid, such that the outlet pipe extends horizontally into the lid, through a side of the lid.

12. The vacuum filter device of claim 9 further comprising:

an inlet pipe, which is in fluid connection with the collection cavity via the filter air intake;

such that an inner end of the filter connection hose is attached to an outer end of the inlet pipe.

13. The vacuum filter device of claim 9 wherein the outlet pipe is configured to extend vertically below the lid, into the collection cavity.

14. The vacuum filter device of claim 10, wherein the filter unit is configured as an elongated tube with a central elongated cavity, such that the filter unit slides on to an inner end of the outlet pipe, such that the inner end of the outlet pipe, is inside the central elongated cavity.

15. The vacuum filter device of claim 9, further comprising a pipe holder, which is mounted in a side of the lid, wherein the outlet pipe is configured with a predetermined length to extend to the side of the lid, such that the outlet pipe is secured in the pipe holder.

16. The vacuum filter device of claim 9, further comprising:

a filter holder, which is cup-shaped, such that the filter holder comprises a holder aperture in an upper portion of the filter holder;

wherein the filter unit is mounted vertically in the lid, such that the filter holder is configured to receive the filter unit in an interior of the filter holder, such that air flows into the filter unit via the holder aperture, whereby the filter holder serves to contain the debris in a lower part of the collection cavity.

17. The vacuum filter device of claim 9, further comprising:

a separation plate, which comprises a plurality of apertures;

wherein the separation plate is horizontally mounted in an interior of the vacuum filter device, to create a separation between a container portion and a filter portion of the interior of the collection box, such that the filter unit is mounted in the filter portion, such that the air flows from the container portion to the filter portion via the plurality of apertures in the separation plate, whereby the separation plate serves to contain the debris in the container portion.

18. The vacuum filter device of claim 9, further comprising:

a separation plate;

wherein the separation plate is vertically mounted in an interior of the vacuum filter device, to create a separation between a container portion and a filter portion of the interior of the collection box, such that the filter unit is mounted in the filter portion, such that the air flows from the container portion to the filter portion via an aperture above the separation plate, whereby the separation plate serves to contain the debris in the container portion.

19. The vacuum filter device of claim 12, wherein the inlet pipe is configured with a downward curve, such that an inner end of the inlet pipe is directed downward, whereby the downward curve serves to contain the debris in a lower part of the collection box.

20. A vacuum filter device for use with a vacuum cleaner, comprising:

a collection box, comprising a collection cavity;

a lid, which is configured to attach to an upper end of the collection box, such that the lid is configured to be removable and airtight when attached to the upper end;

a filter air intake, which is configured as a first opening into the collection cavity;

a filter air exhaust, which is configured as a second opening into the collection cavity;

a filter connection hose;

a filter unit; and an outlet pipe, which is in fluid connection with the collection cavity via the filter air exhaust, such that an outer end of the outlet pipe is configured to attach to an inner end of a vacuum connection hose;

wherein a first end of the filter connection hose is connected to the filter air intake, such that air is sucked in through the filter connection hose;

wherein the vacuum filter device is configured to receive the filter unit, such that the filter unit is connectable to the filter air exhaust;

wherein the filter air exhaust is configured to connect to a vacuum air intake of the vacuum cleaner, via the vacuum connection hose;

wherein the filter unit is connected to the filter air exhaust, such that the filter unit is configured to collect some of remaining debris from the air;

wherein the filter unit is mounted horizontally in the lid, such that the outlet pipe extends horizontally into the lid, through a side of the lid;

such that air is sucked into the collection cavity through the filter air intake, such that the air passes through the collection cavity, wherein the air contains debris, including dust and dirt, whereby some of the debris collects in a bottom of the collection cavity;

such that the vacuum filter device is configured to pass the air from the collection cavity through the filter unit, when the filter unit is connected to the filter air exhaust;

such that the vacuum filter device is configured to pass the air through to the vacuum cleaner, via the vacuum connection hose.

21. A vacuum filter device for use with a vacuum cleaner, comprising:

a collection box, comprising a collection cavity;

a lid, which is configured to attach to an upper end of the collection box, such that the lid is configured to be removable and airtight when attached to the upper end;

a filter air intake, which is configured as a first opening into the collection cavity;

a filter air exhaust, which is configured as a second opening into the collection cavity;

a filter connection hose;

a filter unit; and an outlet pipe, which is in fluid connection with the collection cavity via the filter air exhaust, such that an outer end of the outlet pipe is configured to attach to an inner end of a vacuum connection hose;

wherein a first end of the filter connection hose is connected to the filter air intake, such that air is sucked in through the filter connection hose;

wherein the vacuum filter device is configured to receive the filter unit, such that the filter unit is connectable to the filter air exhaust;

wherein the filter air exhaust is configured to connect to a vacuum air intake of the vacuum cleaner, via the vacuum connection hose;

wherein the filter unit is connected to the filter air exhaust, such that the filter unit is configured to collect some of remaining debris from the air;

wherein the filter unit is configured as an elongated tube with a central elongated cavity, such that the filter unit slides on to an inner end of the outlet pipe, such that the inner end of the outlet pipe, is inside the central elongated cavity;

such that air is sucked into the collection cavity through the filter air intake, such that the air passes through the collection cavity, wherein the air contains debris, including dust and dirt, whereby some of the debris collects in a bottom of the collection cavity;

such that the vacuum filter device is configured to pass the air from the collection cavity through the filter unit, when the filter unit is connected to the filter air exhaust;

such that the vacuum filter device is configured to pass the air through to the vacuum cleaner, via the vacuum connection hose.

22. A vacuum filter device for use with a vacuum cleaner, comprising:

a collection box, comprising a collection cavity;

a lid, which is configured to attach to an upper end of the collection box, such that the lid is configured to be removable and airtight when attached to the upper end;

a filter air intake, which is configured as a first opening into the collection cavity;

a filter air exhaust, which is configured as a second opening into the collection cavity;

a filter connection hose;

an outlet pipe, which is in fluid connection with the collection cavity via the filter air exhaust, such that an outer end of the outlet pipe is configured to attach to an inner end of a vacuum connection hose; and a pipe holder, which is mounted in a side of the lid, wherein the outlet pipe is configured with a predetermined length to extend to the side of the lid, such that the outlet pipe is secured in the pipe holder;

wherein a first end of the filter connection hose is connected to the filter air intake, such that air is sucked in through the filter connection hose;

wherein the vacuum filter device is configured to receive a filter unit, such that the filter unit is connectable to the filter air exhaust;

wherein the filter air exhaust is configured to connect to a vacuum air intake of the vacuum cleaner, via the vacuum connection hose;

such that air is sucked into the collection cavity through the filter air intake, such that the air passes through the collection cavity, wherein the air contains debris, including dust and dirt, whereby some of the debris collects in a bottom of the collection cavity;

such that the vacuum filter device is configured to pass the air from the collection cavity through the filter unit, when the filter unit is connected to the filter air exhaust;

such that the vacuum filter device is configured to pass the air through to the vacuum cleaner, via the vacuum connection hose.

23. A vacuum filter device for use with a vacuum cleaner, comprising:

a collection box, comprising a collection cavity;

a lid, which is configured to attach to an upper end of the collection box, such that the lid is configured to be removable and airtight when attached to the upper end;

a filter air intake, which is configured as a first opening into the collection cavity;

a filter air exhaust, which is configured as a second opening into the collection cavity;

a filter connection hose;

an outlet pipe, which is in fluid connection with the collection cavity via the filter air exhaust, such that an outer end of the outlet pipe is configured to attach to an inner end of a vacuum connection hose; and a filter holder, which is cup-shaped, such that the filter holder comprises a holder aperture in an upper portion of the filter holder;

wherein the filter unit is vertically mountable in the lid, such that the filter holder is configured to receive the filter unit in an interior of the filter holder, such that air flows into the filter unit via the holder aperture, whereby the filter holder serves to contain the debris in a lower part of the collection cavity;

wherein a first end of the filter connection hose is connected to the filter air intake, such that air is sucked in through the filter connection hose;

wherein the vacuum filter device is configured to receive a filter unit, such that the filter unit is connectable to the filter air exhaust;

wherein the filter air exhaust is configured to connect to a vacuum air intake of the vacuum cleaner, via the vacuum connection hose;

such that air is sucked into the collection cavity through the filter air intake, such that the air passes through the collection cavity, wherein the air contains debris, including dust and dirt, whereby some of the debris collects in a bottom of the collection cavity;

such that the vacuum filter device is configured to pass the air from the collection cavity through the filter unit, when the filter unit is connected to the filter air exhaust;

such that the vacuum filter device is configured to pass the air through to the vacuum cleaner, via the vacuum connection hose.

* * * * *